US005300246A

United States Patent [19]

Yamamoto et al.

[11] Patent Number: 5,300,246

[45] Date of Patent: Apr. 5, 1994

[54] SALTY WATER ABSORBING COMPOSITION, SALTY WATER ICE PACK, AND SALTY WATER ABSORBING PACK

[76] Inventors: Masayuki Yamamoto, c/o Limited Company Ichihuji Suisan, 97-1, Tsurugaoka, Tsurugashimacho, Irumagun, Saitama-Pre.; Etsuro Sakagami, c/o Bylo Industrial Co. Ltd., 2-7-10, Shonandai, Hujisawa-City, Kanagawa-Pre.; Iko Ito, 1-7-12-201, Tsukahara, Takatsuki-City, Osaka-Pre., all of Japan

[21] Appl. No.: 853,252

[22] Filed: Mar. 18, 1992

[30] Foreign Application Priority Data

Jun. 6, 1991 [JP] Japan ..... 3-162096

[51] Int. Cl.[5] ..... C09K 3/18

[52] U.S. Cl. ..... 252/70; 165/10; 502/402; 502/527; 252/380; 426/262; 426/654

[58] Field of Search ..... 252/70, 380; 165/10 A; 502/402, 527; 426/262, 654

[56] References Cited

U.S. PATENT DOCUMENTS 4,588,420 5/1986 Charvat ..... 51/298
5,024,865 6/1991 Insley ..... 428/36.4
5,106,520 4/1992 Salyer ..... 252/70
5,114,788 5/1992 Nakagawa et al. ..... 428/284

FOREIGN PATENT DOCUMENTS 0140236 10/1979 Japan .
2230879 10/1987 Japan .

*Primary Examiner*—Patrick P. Garvin
*Assistant Examiner*—E. D. Irzinski
*Attorney, Agent, or Firm*—Wenderoth, Lind & Ponack

[57] ABSTRACT

A salty water absorbing composition, salty water ice packs, and salty water absorbing packs used to preserve freshness of meat, fresh fish and shells, vegetables and other watery food when they are transported over a long distance. The salty water absorbing composition and packs containing the composition absorb drippings or exudation discharged from such food, in particular the salty drippings, which ooze from the fresh fish and shells and other marine products. The salty water absorbing pack containing antibiotic materials is accommodated in a bag made of paper sheet coated with a perforated polymer to construct a salty water absorbing pack. The salty water ice pack is obtained by absorbing the pack with salty water and freezing.

3 Claims, 5 Drawing Sheets

Embodiment 1—5
Embodiment 1—1
Embodiment 1—234
Comparison

Embodiment 1—5

Embodiment 1—1

Embodiment 1—234

Comparison

Embodiment 2—1

Embodiment 2—2

Embodiment 2—3

Comparison 2

Freezer Intrior Time Passage −20°C

Embodiment 3−1

Embodiment 3−2

Comparison

Melting Condition Time Passage

At Room Temp Of 23°C

Embodiment 3—1

Embodiment 3—2

Comparison 3

SALTY WATER ABSORBING COMPOSITION, SALTY WATER ICE PACK, AND SALTY WATER ABSORBING PACK

BACKGROUND OF THE INVENTION

The present invention relates to a salty water absorbing composition, a salty water ice pack, and a salty water absorbing pack, respectively, used when food containing a high water content, such as meat, fresh fish and shells, and fresh vegetables and the like are stored, kept or preserved, and transported. The salty water absorbing composition is adapted to absorb the exudation or drippings discharged from such food as described above, in particular, the exudation discharged from fresh fish and shells with salt contained therein. The salty water ice pack has the effect of controlling the reproduction of bacteria as a result of using ceramics provided with fresh preserving properties and antibiotic characteristics. The salty water absorbing pack is made by soaking salty water in the pack and freezing the soaked pack.

When food containing a high water content, such as meat, fresh fish and shells, and fresh vegetables and the like is stored, kept and displayed in a shop window, exudation or drippings are discharged from the food. Drippings are collected on the bottom of containers and trays, so that appearance of the food in such container is made dirty or soiled, the food is likely to discolor, or generate an unpleasant odor, and preservability is lowered.

As a result of the above problems, the drippings must be removed from the food. When drippings are removed or discarded by exchanging the container or trays for such food, this removing operation is troublesome and the cost of preparing the food is increased. In order to solve the problems of the prior art, sheets of paper and sheets of non-woven cloth to absorb the drippings, for example, are placed or laid on the bottoms of containers and trays so as to absorb the drippings and the soaked sheet thereafter removed. However, it is not sufficient to completely absorb the drippings. As a result, nowadays water absorbing sheets made by packing water absorbing resin by paper or non-woven cloth has come into use.

The conventional water absorbing sheets can only sufficiently soak fresh water-containing drippings, but they cannot effectively absorb salty water containing drippings. This means it has not been possible to preserve fresh fish, shells and the like and to prevent the discoloration thereof.

In addition, in the case where food such as meat, fresh fish and shells, and fresh vegetables are transported over long distances, in general refrigerators and freezing or cold-chain trucks, or ice and dry ice are used. It is apparent that there are restrictions on the volume of food to be transported as well as the transport time. It is said that the transportation of food, such as fresh fish and shells, in a fresh condition over more than a predetermined distance is difficult.

SUMMARY OF THE INVENTION

Considering the problems of the prior art mentioned above, it is the main purpose of the present invention to provide food-drippage absorbing packs and compositions used in the packs, which have a large absorbing capacity for food drippings generated during storage. This makes it possible to preserve, and transport fresh food over long distances without generating bacteria which spoil the food. In addition, a salty water ice pack is provided which exhibits a high salty water drip absorbing effect and a freshness preservation effect.

In order to attain the purposes above, the present invention provides a pack 3 (see FIG. 5) after blending particles or powdered absorbing resin (A) and particles, powders or granular ceramic powder (B) having freshness preservation and antibiotic effects at a weight ratio of (A)/(B)=99/1 to =1/99, preferably (A)/(B)=70/30 to 30/70, and placing the blended composition 1 into a bag made of a plastic film 2 made of a paper, a non-woven cloth, or a perforated polymer sheet, respectively treated antibiotically. The invention also includes a composite of the above, or a salty water absorbing pack made by absorbing salt water of from 0.1 to 5.0 weight percent of concentration of sodium chloride in a saturated or near-saturation state, or a freezing pack made by freezing the salty water absorbing pack (see FIG. 5).

DESCRIPTION OF THE PREFERRED EMBODIMENT

Figure 1:
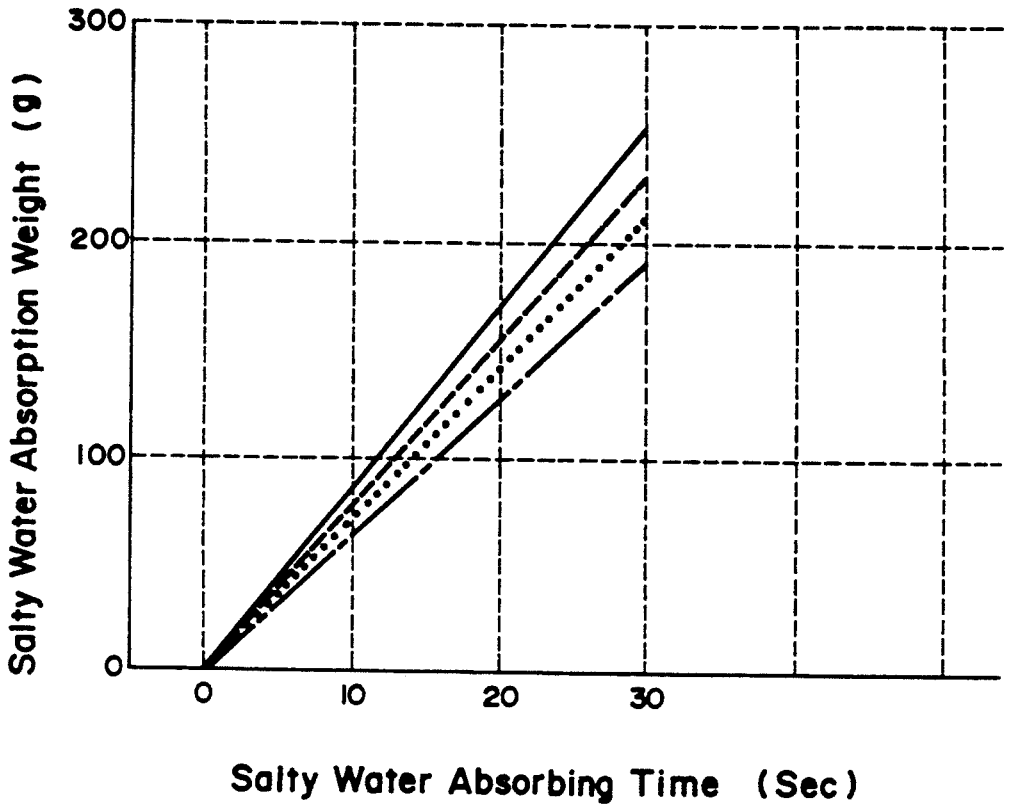
FIG. 1 is a graph depicting the time elapsed for the compositions of Table 1, showing the characteristics of the present invention.

A construction of the present invention will be explained in detail with reference to an embodiment shown in the accompanying embodiment.

The water absorbing resin used in the present invention must be non-soluble in water and possess a high water absorbing capacity to not only fresh water, but also to concentrated salty water. The water absorbing resin preferably has also other properties shown below, that is the resin is: (a) non-toxic, (b) substantially neutral, (c) stable to fat and oil, acid, heat, ultraviolet rays, (d) does not contain natural matter likely to be rotted or deteriorated, for example, starch under usage conditions, and (e) is not deformed after water absorption.

Consequently, synthetic water absorbing resins such as polyvinyl alcohol, and polyacrylic acids having the requirements disclosed above are preferable.

Ceramic powders used in the present invention are oxides of alumina, aluminasilicate, silica, mullite, zeolite, vermiculite and perlite. They must be capable of preserving the freshness of fresh food products, capable of being chemically reacted with heavy metal ions such as copper ions and the like, or capable of absorbing such heavy metals by occlusion in order to also exhibit antibiotic characteristics. It is more preferable to have the following conditions of the ceramic oxides. That is, the ceramic oxides must be: (f) non-toxic, (g) substantial neutral, (h) chemically stable, (i) substantially white, (j) granule or fine powdered form and of large ratio surface area or such that the original shape is preserved after absorbing water and, (k) the melting-out volume of the heavy metal ion is in a permissible range such that it sanitizes food, if antibiotic ceramics containing heavy metal ions are used.

The blending ratio of the water absorbing resin and the ceramic powder used in the present invention can be selected from the range of from 99:1 to 1:99. In order to improve both the water absorbing capacity, and the freshness preservation and antibiotic characteristics, a range from 70:30 to 30:70 is preferred.

The package material of the pack according to the present invention is paper, a non-woven cloth, a perforated plastic film antibiotically treated or a composite of these materials. The package material must be prevented from discharging or oozing out the water absorbing resin and ceramic powder contained in the pack and must be water permeable. In particular, when the water absorbing resin absorbs water and swells, the package material and packaging process must be determined or selected so as not to burst.

The pack of the present invention is especially applicable to preserving meat, fresh fish and shells, fresh vegetables and the like, and preferably marine products of fish and shells when they are stored, preserved, and transported.

The particular embodiment or embodiments of the present invention will be described and should be noted that the present invention is not restricted to those described below.

EMBODIMENT

This embodiment of the present invention has five subembodiments using various ceramic powders and having corresponding salt water absorbing speeds and salt water absorbing volumes. Into a bag 2 (55 mm×90 mm, four corners as sealed) made of nonwoven cloth, a pack 3 containing 2.5 g of water absorbing resin 1 (Sumica Gel N-100, the same resin will be used in other embodiments) and 2.5 g of various ceramic powders shown in the table 1 is packed. Another pack of a comparative example containing 5.0 g of only the water absorbing resin is prepared. These packs are soaked into salt water containing sodium chloride of a concentration of 1.7 weight % and the particular volumes of salt water absorption for each time were measured. The measurement results of the experiments are shown in FIG. 1 and Table 1.

TABLE 1

| No. of Embodiment | water absorbing resin (g)* | ceramic powder kind | grain dia | weight (g) | total weight (g) |
|---|---|---|---|---|---|
| 1 - 1 | 2.5 | vermiculite | | 2.5 | 5.0 |
| 1 - 2 | 2.5 | silica gel | 60 Mesh | 2.5 | 5.0 |
| 1 - 3 | 2.5 | zeolite type A | | 2.5 | 5.0 |
| 1 - 4 | 2.5 | alumina silicate | void | 2.5 | 5.0 |
| 1 - 5 | 2.5 | $Ag^+$ contain ion alumina silicate** | 325 Mesh | 2.5 | 5.0 |
| Comparison | 5.0 | non | | 0 | 5.0 |

In Table 1 above, * means Sumica gel (TM Asahi Kagaku made) N-100 and ** means antibiotically treated ceramics containing silver (Asahi Kagaku made).

As shown in the results of Table 1, the embodiments of the present invention have high salt water absorbing speeds compared to that of the comparison, notwithstanding the light weight of the water absorbing resin contained in one pack, and has good saturated salt water absorbing properties. Comparing the various ceramic powders with each other, it is said that absorbing characteristics of alumina silicate or Vermiculite is superior to that of silica gel and zeolite.

EMBODIMENT 2

Concerning embodiment 2, the salt water absorbing speed and salt water absorbing volume capacity of the pack of the present invention containing the particular inventive ceramic powders will be explained.

Various blends of the ratios as shown in Table 2 of water absorbing resin and ceramic powder of Vermiculite [(Mg, Fe):, (Si, Al, Fe)$_4$O$_{10}$, (OH)$_2$, 4H$_2$O] were packed in a bag (55 mm×90 mm, four corner sealed) made of a non-woven cloth and perforated polyethylene film. The total volumes of the test packs were 5.0 g.

TABLE 2

| Embodiment No. | pack contents water absorbing resin (g) | vermiculite (g) | total volume (g) |
|---|---|---|---|
| 2 - 1 | 3.5 | 1.5 | 5.0 |
| 2 - 2 | 2.5 | 2.5 | 5.0 |
| 2 - 3 | 1.5 | 3.5 | 5.0 |
| Comparison - 2 | 5.0 | | 5.0 |

Figure 2:
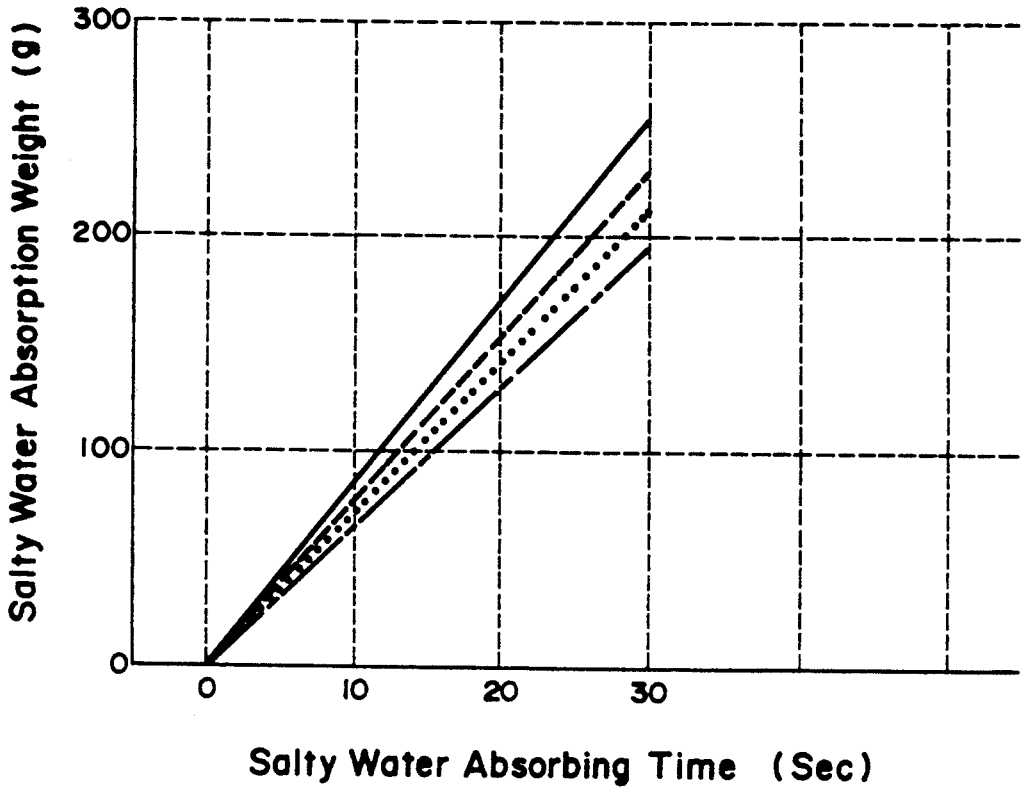
FIG. 2 is another graph of a Table 2 of the present invention.

The comparison was a pack containing only a water absorbing resin of 5.0 g. The test packs and comparison pack were soaked in salty water containing sodium chloride of a concentration: 1.7 weight % and the absorbed water weights were measured resulting in as shown in FIG. 2.

Surprisingly, notwithstanding the fact that the test packs contain a water absorbing resin of a volume less than that of the comparison pack, the salt water absorbing speed was higher.

EMBODIMENT 3

According to this embodiment, the packs containing the composition of the present invention were soaked in salty water, frozen and then melted. The temperature of the interiors of the packs and changes for a time duration will be explained. That is, concerning the embodiment 3, the same packs used in the embodiment 1–2 were used as shown in Table 2, the pack was absorbed to saturation with salty water of sodium chloride: 3 weight % and other packs were absorbed to saturation with fresh water. Concerning the comparison, a pack containing 5.0 g of only water absorbing resin was prepared and the comparison pack was absorbed to saturation with fresh water as shown in Table 3.

TABLE 3

| Embodiment No. | pack contents: water absorbing resin (g) | vermiculite (g) | total weight | liquid absorbed |
|---|---|---|---|---|
| 3 - 1 | 2.5 | 2.5 | 5.0 | 3 weight % saturated salty water |
| 3 - 2 | 2.5 | 2.5 | 5.0 | fresh water saturated |
| Comparison 3 | 5.0 | | 5.0 | fresh water saturated |

These packs with absorbed liquid were left in a freezer of minus 20° C. for a predetermined time to freeze them. The temperature drop curves for the time duration of the pack interiors were shown in FIG. 3. Next, the frozen packs were left at a room temperature of 23° C. for a predetermined time and were melted. The temperature raising curves for the time duration of the pack's interior is shown in FIG. 4.

Figure 3:
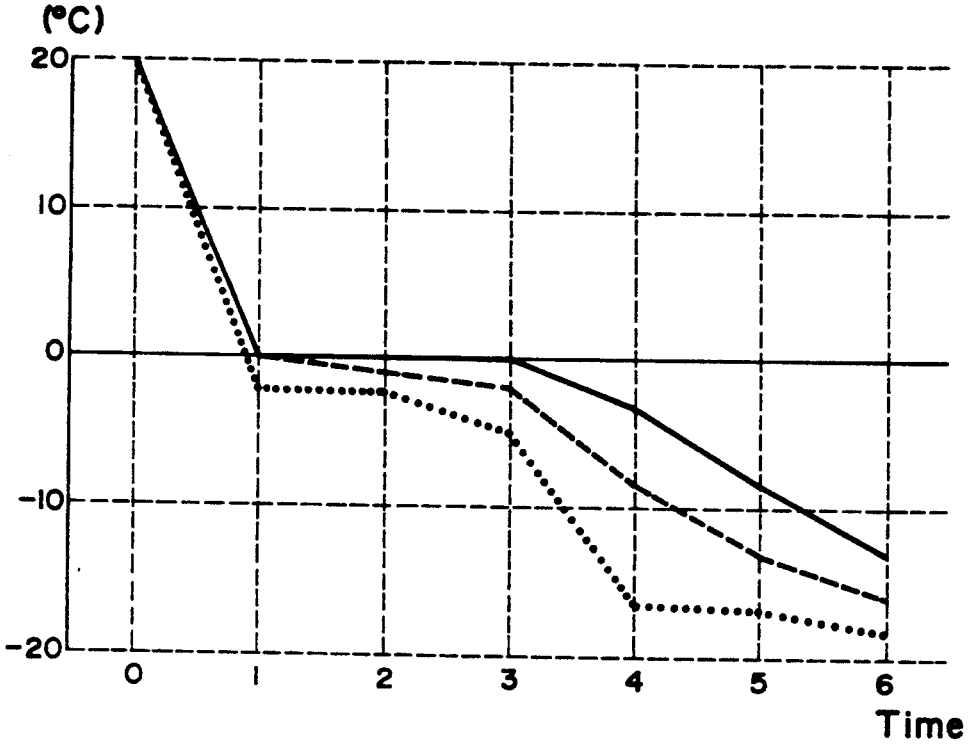
FIG. 3 is still another graph of the compositions of Table 3, showing the characteristics at minus 20° C.
Figure 4:
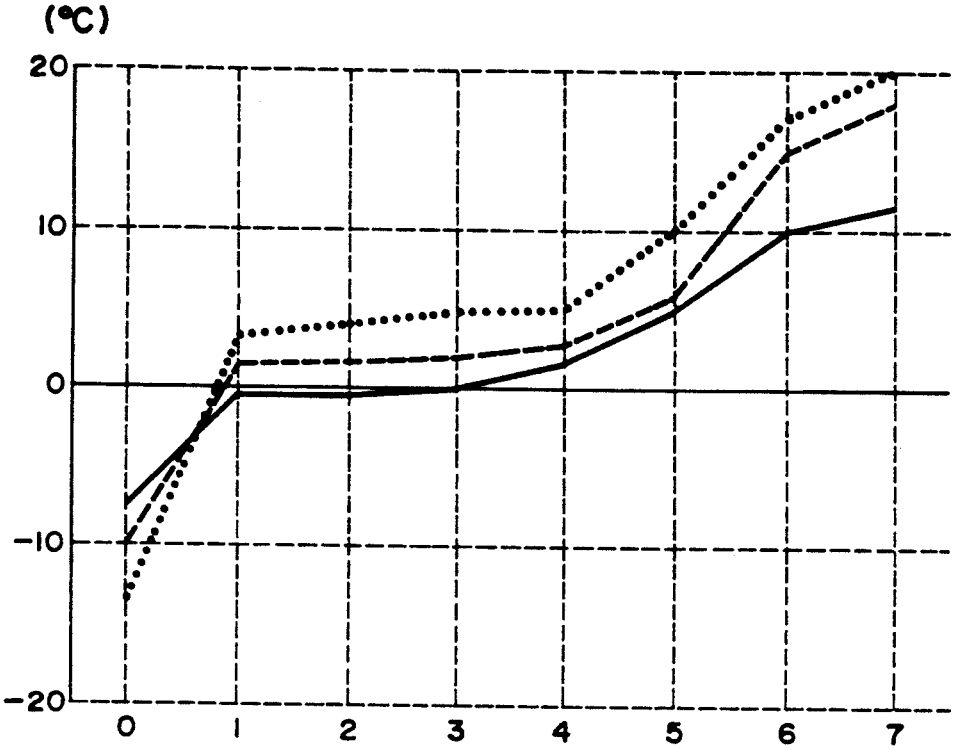
FIG. 4 is a graph depicting the time elapsed for the compositions of Table 3 at 23° C.
Figure 5:
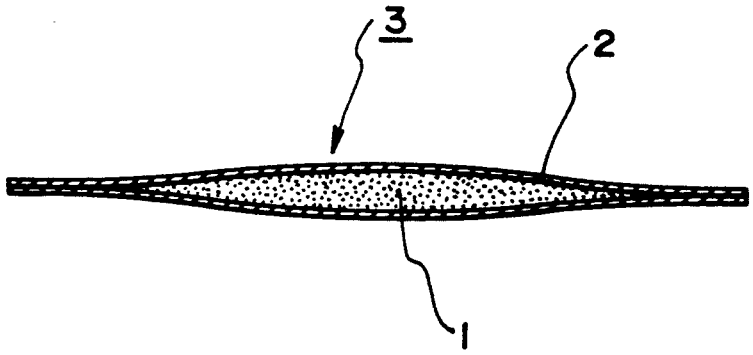
FIG. 5 is a section of a pack according to the present invention.

As shown in FIG. 3 and FIG. 4, the packs containing the composition according to the present invention, in particular packs soaked in salty water has, as compared with the pack of the comparison containing only the water absorbing resin, a temperature drop in the cooling and freezing period, which is slow in its descending speed and has a slow temperature rising in a melting period. It was found that it was preserved for a long time in a low temperature range.

EMBODIMENT 4

According to this embodiment, a pack of the composition of the present invention was absorbed to saturation with salty water of sodium chloride: 3 weight %, and then it was frozen and iced to prepare a salt water ice pack. This salty water ice pack was placed on the bottom of a tray made of foamed polystryol and sliced raw tuna was placed on the ice pack and a wrapping was packed thereon. The package was then placed in an open case of a temperature: zero. The temperature in the tray and the change of condition of the food or raw fish along a time passage were checked. The results are shown in Table 4 and Table 5 compared with the cases of the composition of the pack's contents used in the embodiment.

TABLE 4

| Embodiment No. | pack contents: water absorbing resin (g) | aluminasilicate (g) | total volume |
|---|---|---|---|
| 4 - 1 | 3.0 | 3.0 | 6.0 |
| 4 - 2 | 1.8 | 4.2 | 6.0 |
| 4 - 3 | 0.9 | 2.1 | 3.0 |
| Comparison | 3.0 | 3.0 | 6.0 |

TABLE 5

| Embodiment No. | time passage: after one hour | | | after three hours | | | after 6.5 hours | | |
|---|---|---|---|---|---|---|---|---|---|
| | tempera. | drips | decolor | tempera. | drips | decolor | tempera. | drips | decolor |
| 4 - 1 | 6.5 | none | none | 6.0 | none | none | 5.0 | none | none |
| 4 - 2 | 6.5 | none | none | 6.0 | none | none | 5.0 | none | none |
| 4 - 3 | 6.5 | none | none | 6.0 | none | none | 5.0 | none | none |
| Comparison 4 | 7.5 | none | none | 6.5 | a little | none | 5.2 | much | blacky a little |

It is apparent from the results that in case the salty water ice pack of the present invention was used and sliced raw tuna fish was displayed in the open case, no generation of any drippings and discoloration of the fish was discovered, at least after 6.5 hours. It was thus preserved in a fresh condition.

EMBODIMENT 5

Similar to the embodiment 4, a salty water ice pack prepared by a method shown in the embodiment 4 was placed or laid on the bottom of the tray, and sweet shrimps with heads and shells were placed in a row. A wrapping was laid on the food, and they were placed in the open case at a temperature of zero. Checking the change of conditions of the interior of the tray with time, the checking results were shown in Tables 6 and 7 to express the compositions of the pack's contents.

TABLE 6

| Embodiment No. | pack contents: water absorbing resin (g) | silicagel (g) | total volume (g) | salty water 1.7 weight % absorbed volume (g) |
|---|---|---|---|---|
| 5 - 1 | 3.0 | 3.0 | 6.0 | 265 |
| 5 - 2 | 1.8 | 4.2 | 6.0 | 180 |
| 5 - 3 | 0.6 | 5.4 | 6.0 | 110 |
| Comparison 5 | 3.0 | | 3.0 | 160 |

TABLE 7

| Embodiment No. | time passage: after one day | | after two days | | after four days | |
|---|---|---|---|---|---|---|
| | drips | discolor | drips | discolor | drips | discolor |
| 5 - 1 | none | none | none | none | none | none |
| 5 - 2 | none | none | none | none | none | head discolor a little |
| 5 - 3 | none | none | a little | head discolor a little | a little | the same above |
| Comparison 5 | a little | a little | much | discolor head to body | much | discolor head to body |

It is found from the results above that by using the salty water ice pack of the present invention and by placing the food package in the open case with the ice pack, the freshness of the food is preserved and even sweetened shrimps which are apt to discolor, were preserved for about four days without discoloration.

EMBODIMENT 6

The embodiment 6 was similar to the embodiment 4. A pack having a bag containing a water absorbing resin: 3 g and alumina silicate powder: 3 g was soaked in a salty water containing sodium chloride: 3 weight % and the soaked pack was frozen to prepare a salty water ice pack.

Live tarbos were placed in sea water of 2 liters and the water was kept in a temperature range of 12° C. to 5° C. through an indirect cooling process. According to this embodiment, a salty water ice pack was placed in the foregoing 2 liters of sea water, one pack at a time, and the salty water ice pack was replaced with a new salty water ice pack at a frequency of once a day to observe any change occurring in the 2 liters of the sea water as the days go by. The comparison was kept in a temperature range of from 12° C. to 5° C. without using any ice pack. Table 8 shows the water conditions and the live tarbos condition changes along with the time passage.

TABLE 8

| | time passage | | | | | |
|---|---|---|---|---|---|---|
| | three days | | five days | | seven days | |
| | water | tarbos | water | tarbos | water | tarbos |
| Embodiment 6 | transparent no odor | lively | transparent no odor | lively | a little muddy no odor | lively |
| Comparison 6 | a little muddy no odor | lively | muddy odor | lively | muddy strong odor | all died |

What is claimed is:

1. A salty water absorbing pack for preserving food comprising (A) a granular or powder-like water absorptive resin;

(B) a granular or powdered ceramic having food preservation or antibacterial properties; and (C) an antibiotically treated package material enveloping a blend of (A) and (B), said package material comprising at least one member selected from the group consisting of a sheet of paper, a non-woven cloth, a porous plastic film, or a perforated plastic film;

wherein the weight ratio of said blend is (A)/(B)=99.1 to 1/99 and said pack is freezable.

2. A salty water absorbing pack according to claim 1 which further contains frozen salty water.

3. A salty water absorbing pack according to claim 1 wherein the weight ratio of said blend (A)/(B)=70/30 to 30/70.

* * * * *